US006677911B2

(12) United States Patent
Moheb

(10) Patent No.: US 6,677,911 B2
(45) Date of Patent: Jan. 13, 2004

(54) ANTENNA FEED ASSEMBLY CAPABLE OF CONFIGURING COMMUNICATION PORTS OF AN ANTENNA AT SELECTED POLARIZATIONS

(75) Inventor: Hamid Moheb, Clemmons, NC (US)

(73) Assignee: Prodelin Corporation, Newton, NC (US)

( * ) Notice: Subject to any disclaimer, the term of this patent is extended or adjusted under 35 U.S.C. 154(b) by 97 days.

(21) Appl. No.: 10/060,784

(22) Filed: Jan. 30, 2002

(65) Prior Publication Data

US 2003/0142027 A1 Jul. 31, 2003

(51) Int. Cl.[7] ..... H01Q 13/00; H01P 1/16
(52) U.S. Cl. ..... 343/786; 343/756; 333/21 A
(58) Field of Search ..... 343/756, 786, 343/840; 333/261, 256, 257, 137, 21 A

(56) References Cited

U.S. PATENT DOCUMENTS

| | | | | |
|---|---|---|---|---|
| 3,001,159 A | * | 9/1961 | Hilsinger | 333/257 |
| 3,622,921 A | | 11/1971 | Heeren | |
| 3,731,235 A | | 5/1973 | Ditullio et al. | |
| 4,060,781 A | | 11/1977 | Hudspeth et al. | |
| 4,222,017 A | * | 9/1980 | Foldes | 333/122 |
| 4,311,973 A | | 1/1982 | Nuding et al. | |
| 4,528,528 A | | 7/1985 | Augustin | |
| 5,162,808 A | * | 11/1992 | Kim | 343/786 |
| 5,229,736 A | | 7/1993 | Adams et al. | |
| 5,276,456 A | | 1/1994 | Kim | |
| 5,684,494 A | | 11/1997 | Nathrath et al. | |
| 5,781,087 A | | 7/1998 | Milroy et al. | |
| 6,297,710 B1 | * | 10/2001 | Cook et al. | 333/21 A |
| 2001/0030629 A1 | * | 10/2001 | Moheb | |

FOREIGN PATENT DOCUMENTS

FR 2 609 842 * 7/1988

* cited by examiner

*Primary Examiner*—Michael C. Wilmer
(74) *Attorney, Agent, or Firm*—Alston & Bird LLP

(57) ABSTRACT

The present invention provides antenna feed assemblies that allow the common waveguide portion of an antenna feed assembly to be rotated independent of a fixed communication waveguide. When rotated, the ports of the common waveguide are altered in terms of polarization with respect to signals propagating in the common waveguide, while the predetermined polarization between the ports remains the same. A rotatable coupling between the common waveguide and the fixed communication waveguide allows for communication of signals between the two waveguides, even though their ports are rotated with respect to each other. As such, the polarization of the waveguides associated with the antenna may be reconfigured, even though one of the waveguides remains at a fixed position.

24 Claims, 7 Drawing Sheets

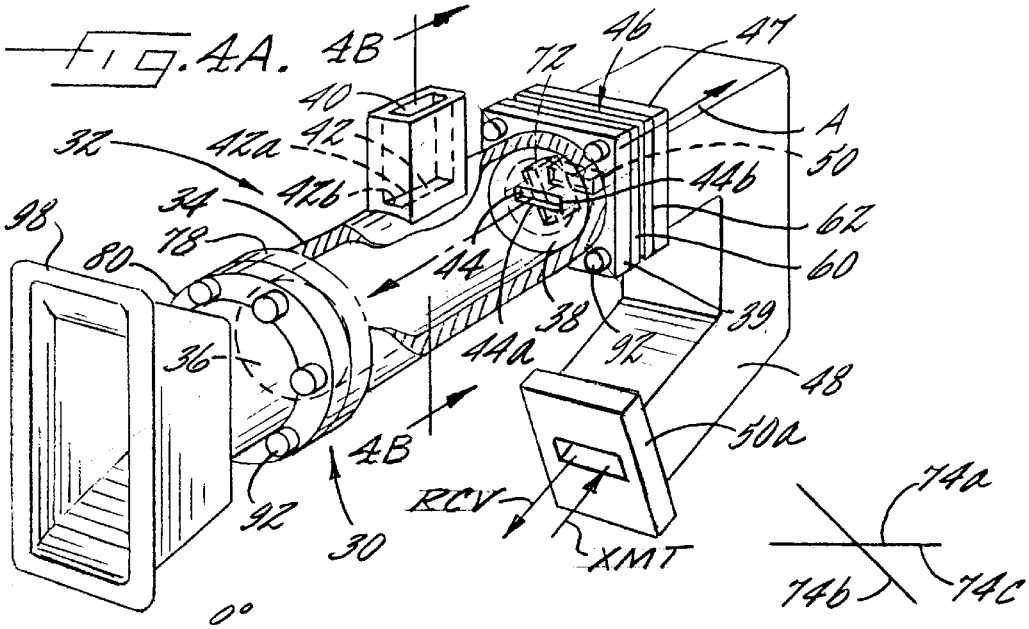
FIG. 4A.
FIG. 4C.
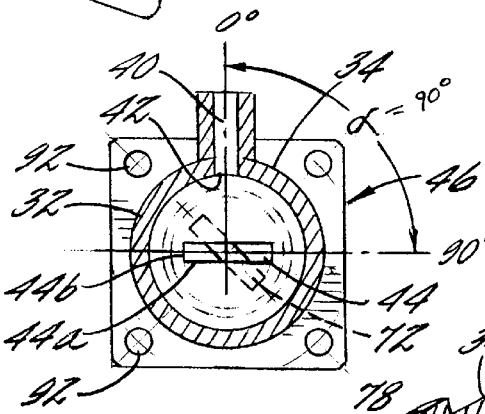
FIG. 4B.
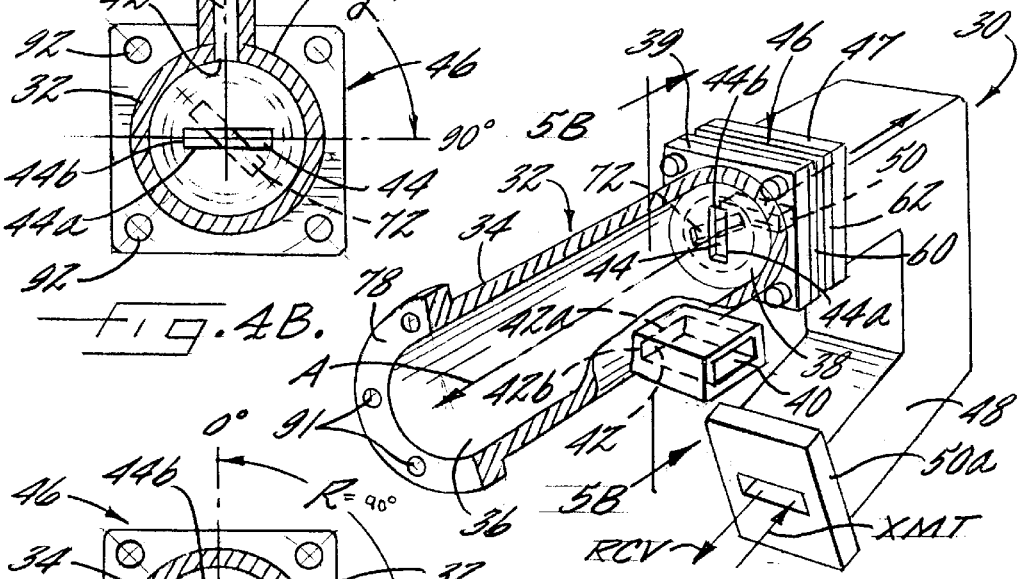
FIG. 5A.
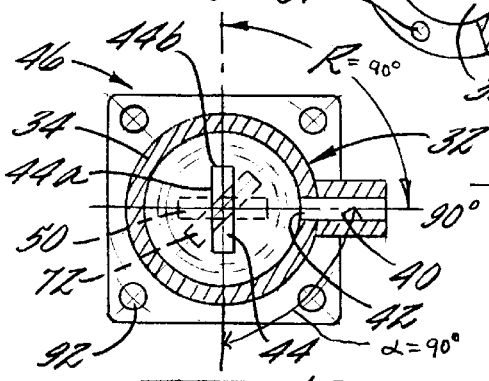
FIG. 5B.
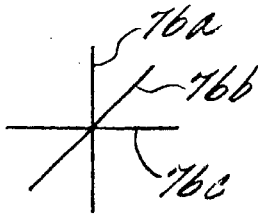
FIG. 5C.

ANTENNA FEED ASSEMBLY CAPABLE OF CONFIGURING COMMUNICATION PORTS OF AN ANTENNA AT SELECTED POLARIZATIONS

FIELD OF THE INVENTION

The present invention relates generally to antennas for satellite-based communication systems, and more particularly to antenna feed assemblies capable of configuring the communication ports of an antenna at selected polarizations.

BACKGROUND OF THE INVENTION

In the past few years, there has been a significant increase in the number of satellite-based communication systems. As with other types of communication systems, however, there is a limited amount of bandwidth to handle this increase. For this reason, a technique known as frequency reuse is typically implemented. In this technique, signals used in communication with a satellite, (such as two receive signals or a transmit and receive signal), are oriented in polarization planes with respect to each other, so that both signals can reside on the same channel, (one in each plane). As such, the channel is used for communication of two signals as opposed to just one, thereby increasing the amount of information that may communicated on each channel of the frequency band. The signals may be either at the same polarization, (co-polarized), orthogonal to each other, (cross-polarized), or at a predetermined polarization difference.

Antennas used in frequency reuse applications, typically include a feed assembly for coupling either two receive waveguides or a transmit and receive waveguide to a common feedhorn, depending on the requirements for the antenna application. The orientation of the ports of the common waveguide for connecting the receive and transmit waveguides to the feed assembly determine the polarization for each waveguide. As an aid to understanding this concept, FIGS. 1A and 1B respectively illustrate cross- and co-polarization configurations of the ports of a common waveguide. Although not illustrated, the ports could be configured at any predetermined polarization by altering the orientation of the ports relative to each other.

FIG. 1A illustrates an antenna feed assembly 10 with cross-polarization. The assembly includes a common waveguide 12 having a first end 14 for connection to the feedhorn of an antenna, not shown. The common waveguide also includes two ports, 16 and 18, for connection to either two receive waveguides, two transmit waveguides, or a transmit and a receive waveguide. The ports, 16 and 18, are rectangular in shape so as to receive or transmit only one polarization signal. As illustrated in FIG. 1A, the first port 16 has a longitudinal dimension 16*a* that extends in parallel with the longitudinal axis A of the common waveguide, and the second port 18 has a longitudinal dimension 18*a* that extends perpendicular to the longitudinal extension A of the common waveguide. In a cross-polarization configuration, the longitudinal dimension 16*a* of the first port 16 and the longitudinal axis A define a first plane extending vertically in FIG. 1A substantially bisecting the common waveguide. The longitudinal dimension 18*a* of the second port 18 and the longitudinal axis A define a second plane extending substantially horizontally in FIG. 1A and perpendicular to the first plane. In this configuration, signals with one polarization are accepted by the first port 16, while signals with an orthogonal polarization are accepted by the second port 18. In a cross-polarization configuration, the common waveguide is typically referred to as an orthogonal mode transducer (OMT).

FIG. 1B illustrates the first and second ports in a co-polarization orientation. In this instance, the longitudinal dimension 16*a* of the first port 16 and the longitudinal axis A define a first plane extending horizontally in FIG. 1B, and the longitudinal dimension 18*a* of the second port 18 and the longitudinal axis A define a second plane extending substantially horizontally in FIG. 1B such that the first and second planes are substantially coplanar. In a co-polarization configuration, the common waveguide is typically referred to as a diplexer.

Although these antennas provide proper orientations for operating with signals that are at different polarizations, there are some current problems with the manufacture and implementation of these antennas. Specifically, signal conventions for the transmission and reception of signals may vary in different areas of the world depending on the position of satellites and possible interference between different communication signals. For example, in some areas, the received signals propagate in a horizontal plane, and the transmitted signals propagate in a vertical plane, while in other areas of the world the communication signals are oriented in an opposite configuration. In light of this, antennas must either be individually manufactured for the different signal configurations, or the antennas must be configurable in the field to select the proper configuration of the wave-guides. To decrease cost, however, it is typically preferable to manufacture one antenna that can be reconfigured in the field based on the location and the application in which it is used.

With reference to FIGS 1A and 1B, for in-field configuration, the antenna feed assembly must be rotated so as to place the ports of the waveguides in proper polarization orientation with respect to the communication signals. For example, by rotating the feed assemblies of FIGS 1A and 1B by ninety (90) degrees R the waveguides are switched in polarization. To facilitate in-field configuration, many conventional systems include a flange 20 connecting the common waveguide 12 and to the feedhorn of the antenna. During configuration, the common waveguide, as well as receiver electronics 22 and transmitter 24 connected to the common waveguide, are all rotated to the proper polarization for the application in which the antenna is used.

Although in-field configuration decreases time and cost in manufacturing, there are still drawbacks to this conventional solution. Specifically, the transmitter of an antenna is typically an expensive portion of the overall cost of the antenna. Also, given the complexity of most transmitters, they are more susceptible to damage from mishandling. Designs such as those shown in FIGS 1A and 1B that require rotation of the transmitter during in-field configuration are thus less advantageous, as it is more likely that the transmitter of the antenna can be damaged.

In addition, some new antenna designs do not allow for rotation of both of the transmitter and receiver waveguides connected to the antenna feed assembly. Specifically, the assignee of the present application has designed a new antenna that advantageously reduces the overall size of the antenna and reduces the moment forces on the support structure of the antenna. This new antenna design places the transmitter or receiver electronics on the boom arm of the antenna, as opposed to an in-line configuration behind the feedhorn, making the antenna more compact. By attaching the transmitter or receiver to the boom arm in a fixed configuration, the antenna or receiver cannot be rotated with the common waveguide to reconfigure the polarization of the antenna in the field using conventional techniques. This newly designed antenna is described in U.S. patent application Ser. No. 09/797,012, filed Mar. 1, 2001, now U.S. Pat. No. 6,417,815, and entitled: ANTENNAS AND FEED SUPPORT STRUCTURES HAVING WAVEGUIDES CONFIGURED TO POSITION THE ELECTRONICS OF THE ANTENNAS IN A COMPACT FORM, the contents of which are herein incorporated by reference.

As such, an antenna feed assembly design is needed that allows for easy in-field configuration of the polarization of the waveguides of the antenna. Further, the antenna feed assembly should allow, the feed assembly to be rotated to place the antenna in proper polarization even though one of the waveguides connected to the feed assembly is in a fixed position.

SUMMARY OF THE INVENTION

As set forth below, the present invention provides antenna feed assemblies that overcome many of the deficiencies associated with configuring the waveguides of an antenna into a proper polarization configuration. Specifically, the present invention provides antenna feed assemblies that allow the common waveguide portion of the antenna to be rotated independent of a fixed communication waveguide. When rotated, the ports of the common waveguide are altered in terms of polarization with respect to signals propagating in the common waveguide, while the predetermined polarization between the ports remains constant. A rotatable coupling between the common waveguide and the fixed communication waveguide-allows for communication of signals between the two waveguides, even though their ports are rotated with respect to each other. As such, the polarization of the waveguides associated with the antenna may be reconfigured, even though one of the waveguides remains at a fixed position.

For example, in one embodiment of the present invention, the antenna feed assembly includes a common waveguide having a body extending longitudinally between first and second ends and an opening located in the body at a point between the first and second ends. The first end of the assembly is capable of connection to a feedhorn of an antenna, and the second end is capable of connection to a fixed communication waveguide. The assembly also includes a first port in communication with the opening of the common waveguide and a second port in communication with the second end of the common waveguide. The first and second ports define respective polarizations and have a predetermined difference in polarization between each other, which may be a zero difference.

The antenna feed assembly of this embodiment further includes a rotatable coupling connected between the second end of the common waveguide and the fixed communication waveguide. This rotatable coupling allows the common waveguide to rotate with respect to the fixed communication waveguide to thereby alter the polarizations of the first and second ports associated with the common waveguide. Importantly, the rotatable coupling includes a first portion rotatably connected to a second portion. The second portion of the rotatable coupling includes a port oriented such that when the first and second portions are rotated with respect to each other, the polarization of the port of the rotatable coupling is altered with respect to the first portion of the rotatable coupling.

In use, the port of the rotatable coupling acts as an intermediary conduit for signals between the second end of the common waveguide and the fixed communication waveguide. As such, even though the first and second ports associated with the common waveguide are rotated to different polarizations, signals communicated between the second port associated with the common waveguide and the port of the fixed waveguide are properly communicated due to the port of the rotatable coupling. Specifically, if the polarization of the second port associated with the common waveguide is rotated with respect to the port of the fixed waveguide, the port of the rotatable coupling effectively rotates the polarization of the signal, such that it will be properly communicated between the second port of the common waveguide and the port of the fixed waveguide.

As mentioned above, the antenna feed assembly includes first and second ports associated with the common waveguide. Depending on the embodiment, the second port may be an integral part of either the common waveguide or the rotatable coupling. For example, in one embodiment, the second port is an integral portion of the common waveguide and is adjacent to the second end of the common waveguide. In an alternative embodiment, the second port is an integral part of the first portion of the rotatable coupling, where it is rotatable with respect to the port located in the second portion of the rotatable coupling.

As mentioned, the rotatable coupling is positioned between the common waveguide and the fixed waveguide to allow the common waveguide to be rotated with respect to the fixed communication waveguide. In one embodiment, the second end of the common waveguide and the rotatable coupling further include flanges for mating the two together. The flanges include a pattern of openings therethrough corresponding to each other. In this embodiment, the assembly further includes fasteners extending through the openings in the flanges to retain the common waveguide and rotatable coupling in a fixed configuration. To reconfigure the polarization of the ports of the common waveguide, the fasteners are loosened so that the common waveguide is rotatable. The common waveguide, via the rotatable coupling, is then rotated through a desired angle to place the ports of the common waveguide in a new polarization orientation. The fasteners are then retightened to place the waveguide and rotatable coupling in a fixed position.

In the antenna feed assembly discussed above, the rotatable coupling of the present invention allows the common waveguide to rotate with respect to the fixed communication waveguide. In this embodiment, both the common waveguide and the antenna feedhorn are rotated. In some antenna configurations, however, it is important that the feedhorn also remain at a fixed position. Specifically, when an antenna includes a circular reflector and a circular feedhorn, the feedhorn can be rotated along with the common waveguide without offsetting the symmetry between the feedhorn and antenna. However, when the reflector is irregularly shaped, such as elliptical, rotation of the feedhorn relative to the reflector will offset the symmetry between them.

For this reason, in one embodiment, the common waveguide of the present invention further includes a flange connected to the first end for connecting the common waveguide to a flange of the feedhorn of the antenna. The flange of the common waveguide has a pattern of openings corresponding to openings in the flange of the feedhorn. The assembly further includes removable fasteners that extend through the openings in the flanges to retain the common waveguide and feedhorn in a fixed configuration.

When the common wave-guide is to be rotated, the fasteners are removed from the flange connecting the common waveguide and the feedhorn. Further, the fasteners in the flanges between the common waveguide and the rotatable coupling are loosened. The common waveguide, via the rotatable coupling, is then rotated relative to the feedhorn and the common waveguide to reconfigure the polarization orientation of the ports of the common waveguide. The fasteners are then reconnected between the flanges of the common waveguide and the feedhorn, and the fasteners between the common waveguide and the rotatable coupling are retightened to fix the common waveguide at the new position.

As discussed above, the first and second ports associated with the common waveguide are at a predetermined polarization with respect to each other to communicate signals at the proper orientation with the satellites. This predetermined difference in polarization can be any value depending on the application in which the antenna will be used. In one specific example, the common waveguide of the present invention may be an OMT. In this embodiment, the first and second ports are in a cross-polarization orientation with respect to each other with a difference in polarization of ninety (90) degrees. When rotated, the ports will remain orthogonal with respect to each other, but their polarization with respect to the signals propagating in the common waveguide will be altered.

In an alternative embodiment, the common waveguide is a diplexer in which the first and second ports are in a co-polarization orientation with respect to each other, with a difference in polarization of zero (0) degrees. When rotated, the ports will remain at the same polarization with respect to each other, but their polarization with respect to the signals propagating in the common waveguide will be altered.

In still other alternative embodiments, the first and second ports of the common waveguide are at a polarization relative to each that is at an angle other than zero (0) or ninety (90) degrees. When rotated, the ports will remain at the same polarization with respect to each other, but their polarization with respect to the signals propagating in the common waveguide will be altered.

As mentioned, the rotatable coupling of the present invention allows the common waveguide to rotate with respect to the fixed waveguide to reorient the polarization of the ports of the common waveguide. The rotation of the common waveguide can be to any angle, and in most embodiments, the rotation is an angle in the range of 0 to 90 degrees. For angles other than 0 and 90 degrees, the common waveguide will typically be circular as opposed to rectangular.

The present invention also provides an antenna that incorporates the antenna feed assembly of the present invention. The antenna includes a reflector for directing signals transmitted to or from the antenna. Extending from the reflector in a forward direction is at least one boom arm. Connected to the end of the boom arm is a feedhorn directed at the reflector for receiving and transmitting signals. Importantly, the antenna also includes a common waveguide connected to the feedhorn. The common waveguide has a body extending longitudinally between first and second ends and an opening in the body at a point between the first and second ends. Associated with the common waveguide is a first port in communication with the opening of the common waveguide and a second port in communication with the second end common waveguide. The first and second ports define respective polarizations and have a predetermined difference in polarization between each other.

The antenna also includes a fixed waveguide for communication with the feedhorn fixedly connected to the boom arm of the antenna and to the second end of the common waveguide. To rotate the common waveguide relative to the fixed communication waveguide, the antenna includes a rotatable coupling connected between the second port of the common waveguide and the fixed waveguide. The coupling allows the common waveguide to rotate with respect to the fixed waveguide to thereby alter the polarizations defined by the first and second ports while maintaining the predetermined difference in polarization between the first and second ports.

BRIEF DESCRIPTION OF THE DRAWINGS

Figure 1A:
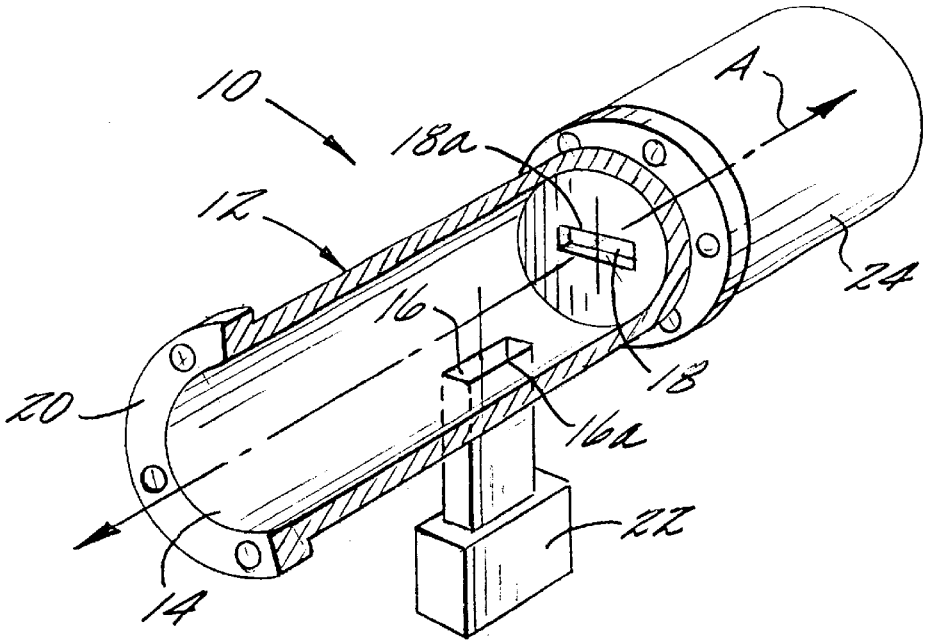
FIG. 1A. (PRIOR ART)
Figure 1B:
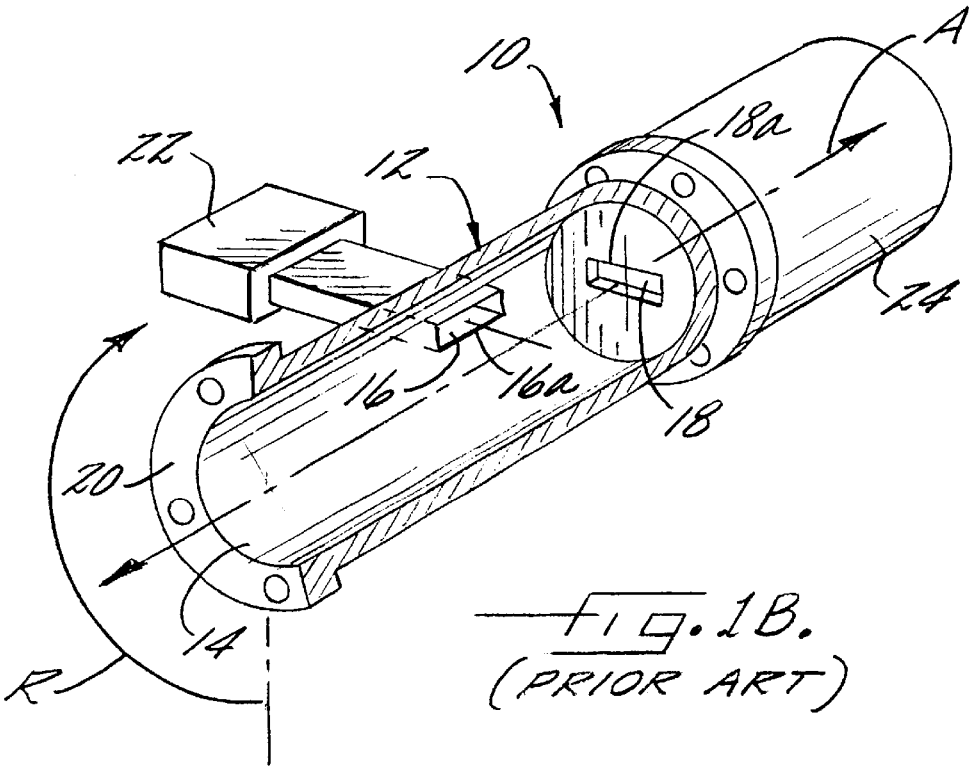
FIG. 1B. (PRIOR ART)

Having thus described the invention in general terms, reference will now be made to the accompanying drawings, which are not necessarily drawn to scale, and wherein:

FIGS. 1A and 1B respectively illustrate cross- and co-polarization orientations of the ports of a common waveguide of an antenna feed assembly as known in the art.

Figure 2:
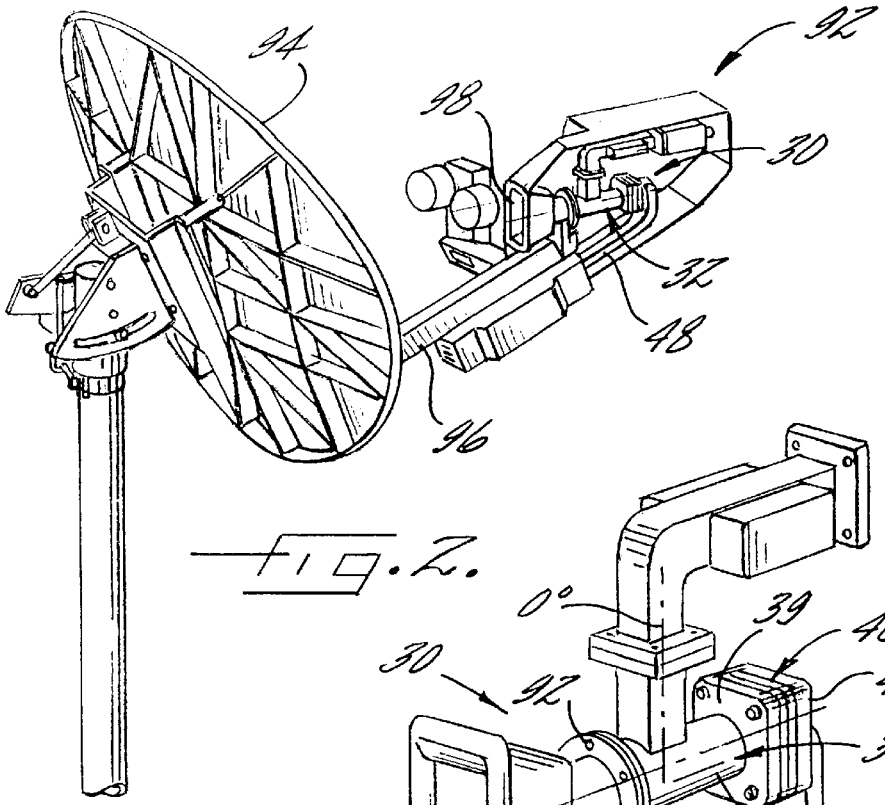

FIG. 2 illustrates an antenna incorporating an antenna feed assembly according to one embodiment of the present invention having ports in cross-polarization orientation according to one embodiment of the present invention.

Figure 3A:
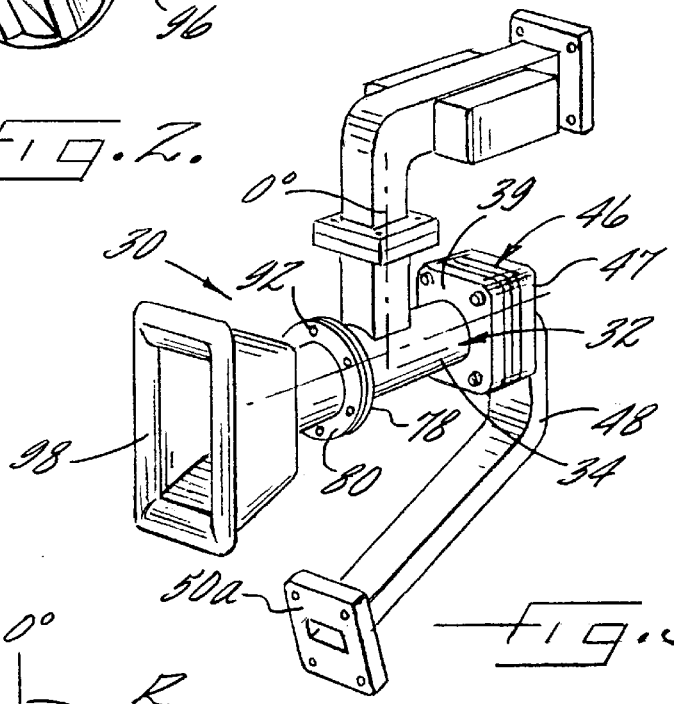
Figure 3B:
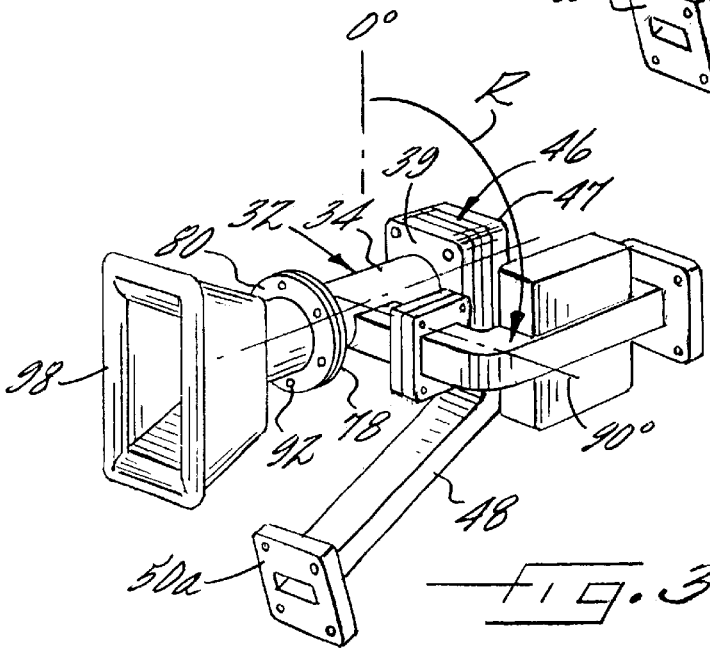

FIGS. 3A and 3B respectively represent the antenna feed assembly of the present invention as illustrated in FIG. 2 with the common waveguide of the assembly at respective zero (0) and ninety (90) degree orientations with respect to the fixed communication waveguide.

FIG. 4A illustrates an antenna feed assembly having ports in cross-polarization orientation, where the common waveguide and fixed communication waveguide are at zero (0) degree orientation with respect to each other according to one embodiment of the present invention.

FIG. 4B illustrates a cross-sectional view along cut line 4B—4B of the common waveguide illustrated in FIG. 4A.

FIG. 4C illustrates rotation in polarization of a signal as it propagates between a common waveguide having cross-polarized ports and a fixed communication waveguide, where the waveguides are at a zero (0) degree orientation with respect to each other as illustrated in FIG. 4A according to one embodiment of the present invention.

FIG. 5A illustrates an antenna feed assembly having ports in cross-polarization orientation, where the common waveguide and fixed communication waveguide are at ninety (90) degree orientation with respect to each other according to one embodiment of the present invention.

FIG. 5B illustrates a cross-sectional view along cut line 5B–5B of the common waveguide illustrated in FIG. 5A.

FIG. 5C illustrates rotation in polarization of a signal as it propagates between a common waveguide having cross-polarized ports and a fixed communication waveguide, where the waveguides are at a ninety (90) degree orientation with respect to each other as illustrated in FIG. 5A according to one embodiment of the present invention.

Figure 6A:
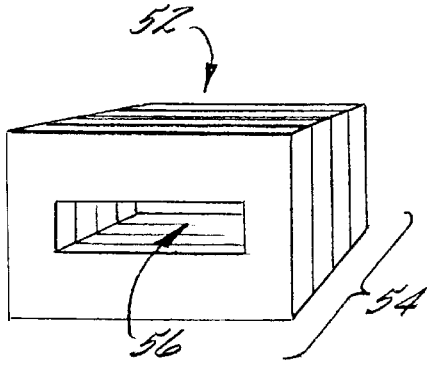

FIG. 6A illustrates a generalized view of a rotatable coupling as known in the art at a zero (0) degree rotation that could be incorporated into embodiments of the present invention.

Figure 6B:
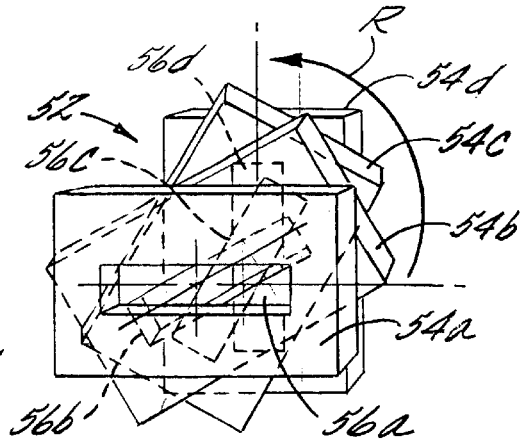

FIG. 6B illustrates a generalized view of a rotatable coupling as known in the art at a ninety (90) degree rotation that could be incorporated into embodiments of the present invention.

Figure 6C:
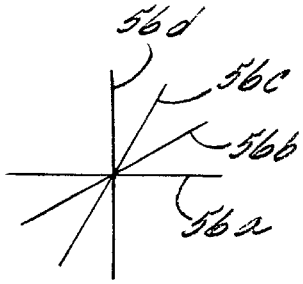

FIG. 6C illustrates rotation in polarization of a signal as it propagates through the conventional rotatable coupling of FIG. 6A.

Figure 7:
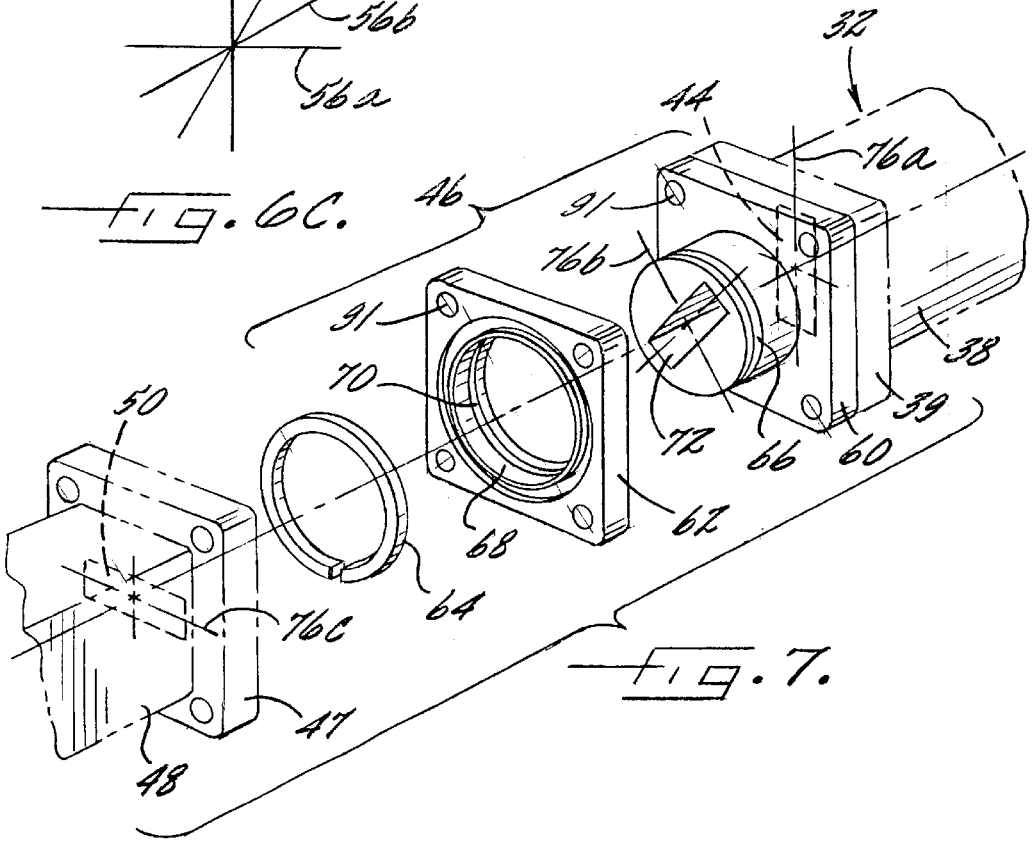

FIG. 7 illustrates an exploded perspective view of a rotatable coupling according to one embodiment of the present invention flipped front to back from the way it appears in FIGS. 4A, 5A, 9A, 10A, 11A, and 12A.

Figure 8A:
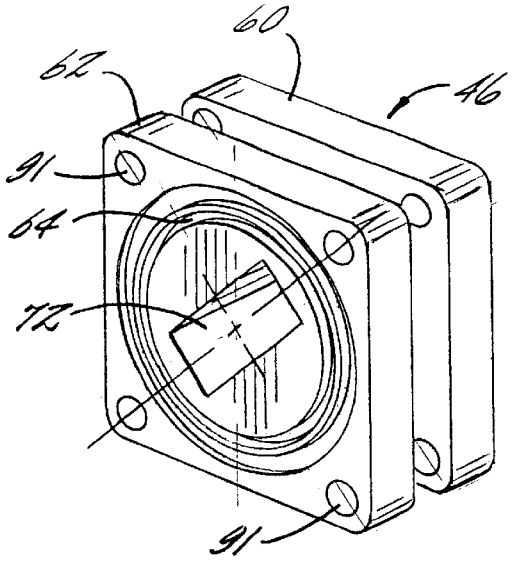
Figure 8B:
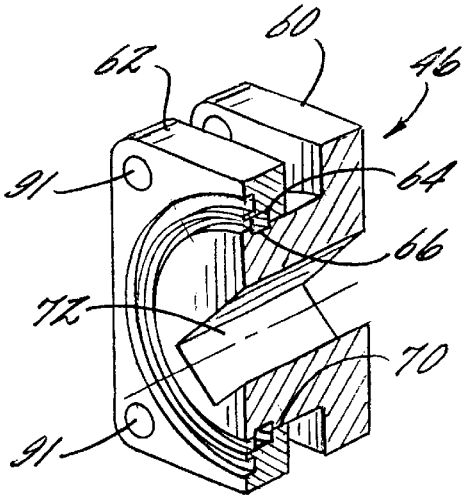

FIGS. 8A and 8B respectively illustrate perspective and cross-sectional perspective views of a rotatable coupling according to the present invention at a zero (0) degree orientation, with the coupling flipped front to back in the figure from the way it appears in FIGS. 4A, 5A, 9A, 10A, 11A, and 12A.

Figure 8C:
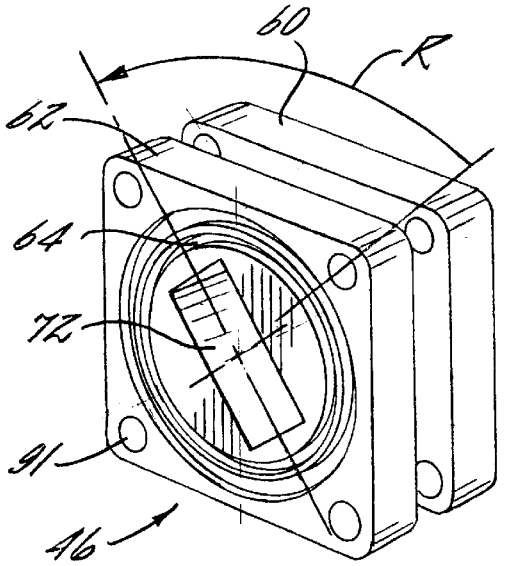
Figure 8D:
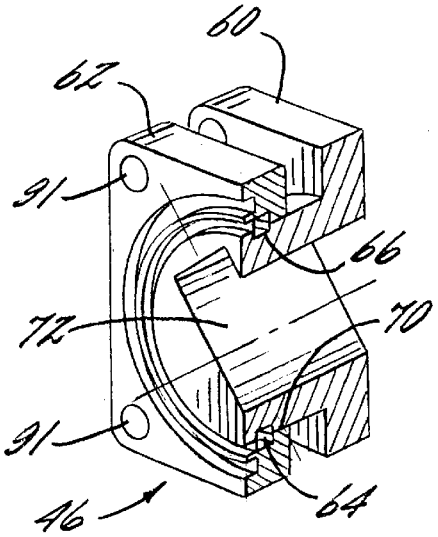

FIGS. 8C and 8D respectively illustrate perspective and cross-sectional perspective views of a rotatable coupling according to the present invention at a at a ninety (90) degree orientation, with the coupling flipped front to back in the figure from the way it appears in FIGS. 4A, 5A, 9A, 10A, 11A, and 12A.

Figure 9A:
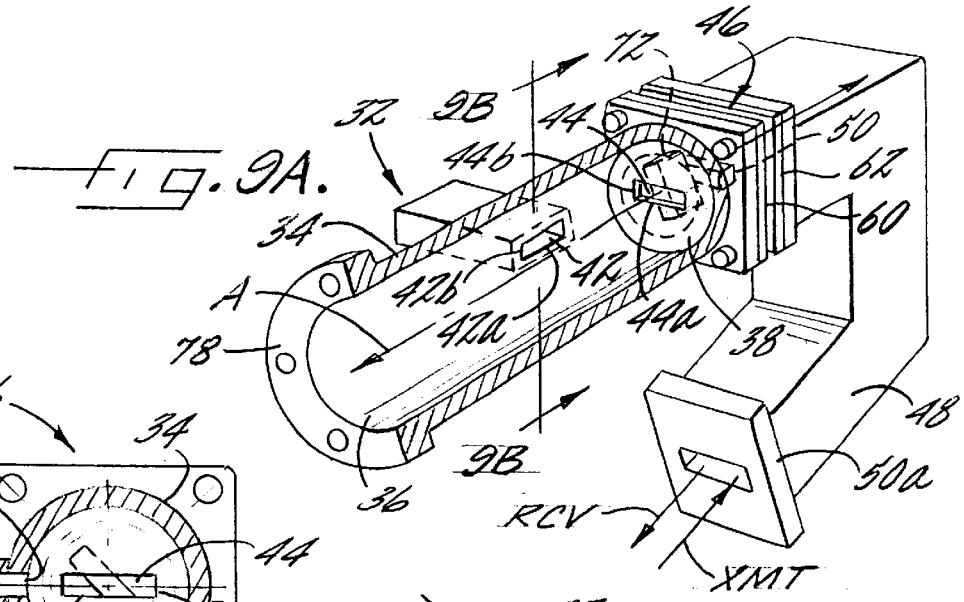

FIG. 9A illustrates an antenna feed assembly having ports in co-polarization orientation, where the common waveguide and fixed communication waveguide are at zero (0) degree orientation with respect to each other according to one embodiment of the present invention.

Figure 9B:
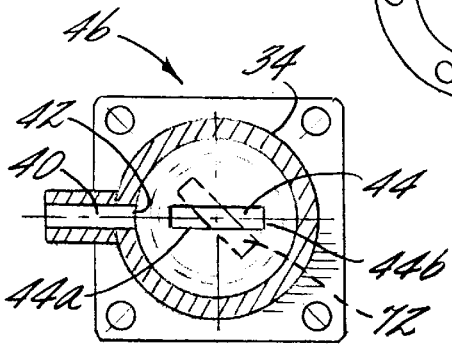

FIG. 9B illustrates a cross-sectional view along cut line 9B—9B of the common waveguide illustrated in FIG. 9A.

Figure 9C:
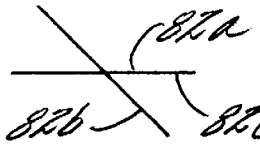

FIG. 9C illustrates rotation in polarization of a signal as it propagates between a common waveguide having co-polarized ports and a fixed communication waveguide, where the waveguides are at a zero (0) degree orientation with respect to each other as illustrated in FIG. 9A according to one embodiment of the present invention.

Figure 10A:
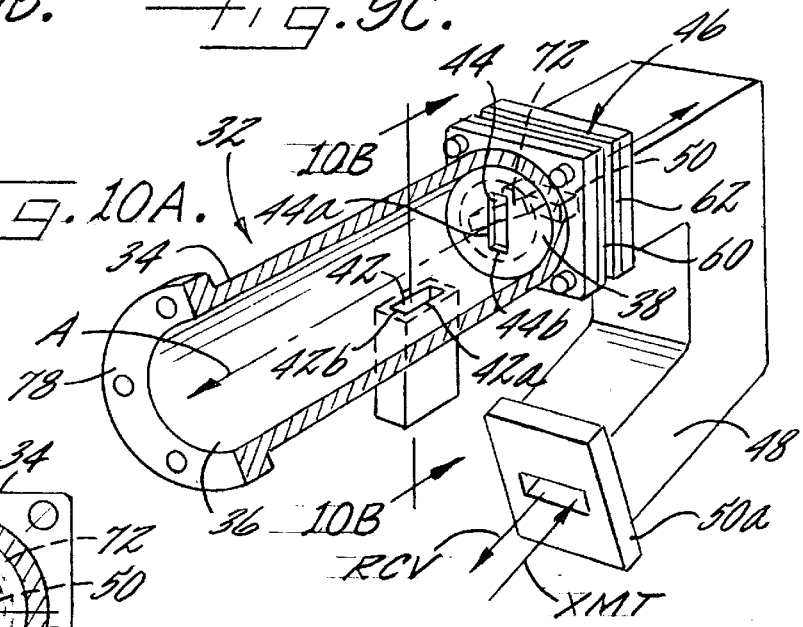

FIG. 10A illustrates an antenna feed assembly having ports in co-polarization orientation, where the common waveguide and fixed communication waveguide are at ninety (90) degree orientation with respect to each other according to one embodiment of the present invention.

Figure 10B:
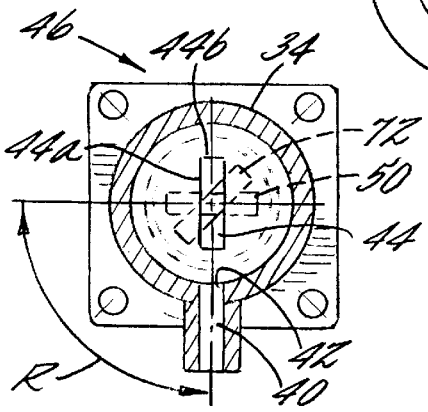

FIG. 10B illustrates a cross-sectional view along cut line 10B—10B of the common waveguide illustrated in FIG. 10A.

Figure 10C:
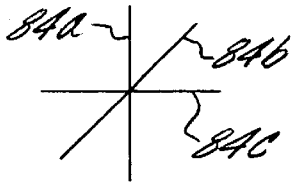

FIG. 10C illustrates rotation in polarization of a signal as it propagates between a common waveguide having co-polarized ports and a fixed communication waveguide, where the wave-guides at a ninety (90) degree orientation with respect to each other as illustrated in FIG. 10A according to one embodiment of the present invention.

Figure 11A:
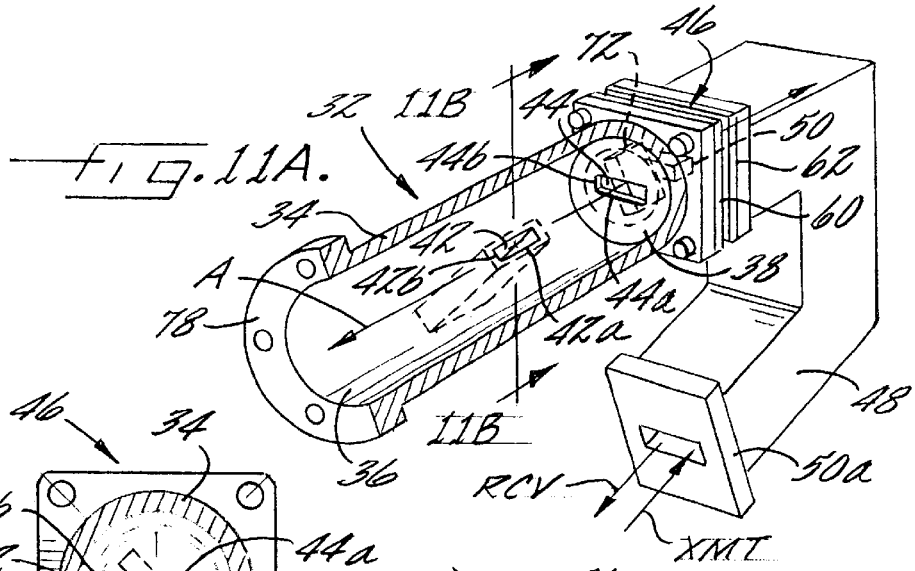

FIG. 11A illustrates an antenna feed assembly having ports at an angle α polarization orientation with respect to each other, where the common wave-guide and fixed communication wave-guide are at zero (0) degree orientation with respect to each other according to one embodiment of the present invention.

Figure 11B:
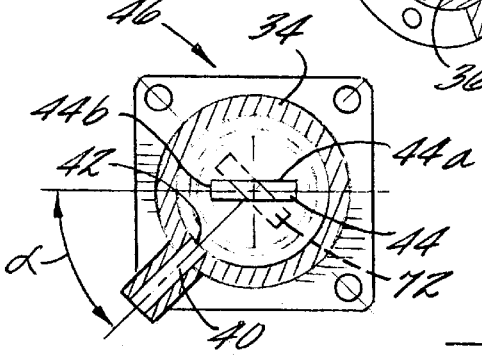

FIG. 11B illustrates a cross-sectional view along cut line 11B—11B of the common waveguide illustrated in FIG. 11A.

Figure 11C:
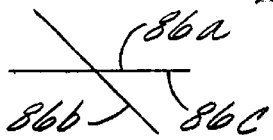

FIG. 11C illustrates rotation in polarization of a signal as it propagates between a common waveguide having ports that are at an angle α polarization orientation with respect to each other and a fixed communication waveguide, where the waveguides are at a zero (0) degree orientation with respect to each other as illustrated in FIG. 11A according to one embodiment of the present invention.

Figure 12A:
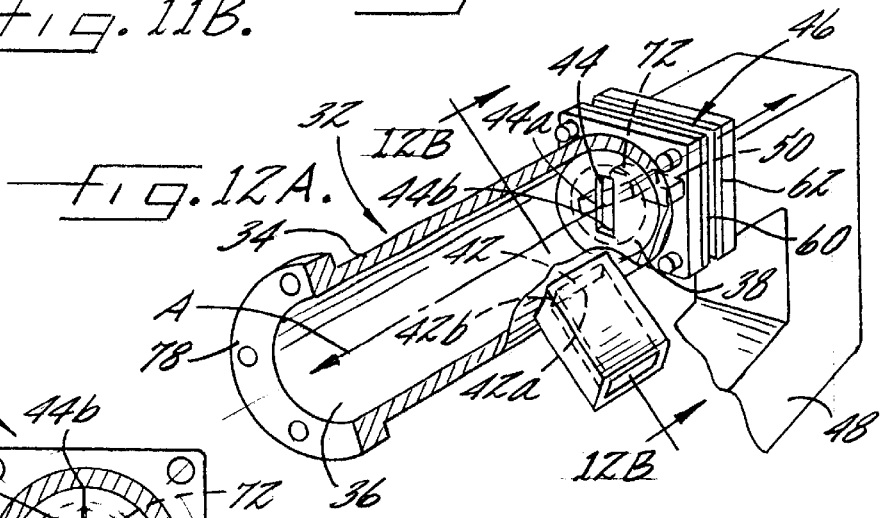

FIG. 12A illustrates an antenna feed assembly having ports at an angle a polarization orientation with respect to each other, where the common wave-guide and fixed communication wave-guide are at ninety (90) degree orientation with respect to each other according to one embodiment of the present invention.

Figure 12B:
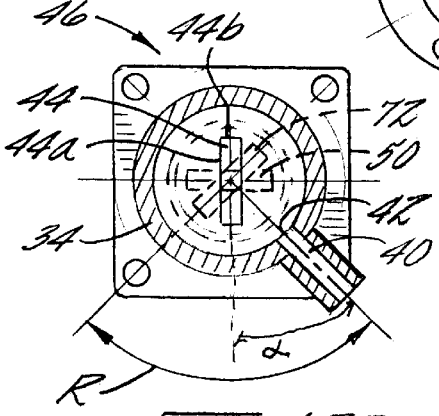

FIG. 12B illustrates a cross-sectional view along cut line 12B—12B of the common waveguide illustrated in FIG. 12A.

Figure 12C:
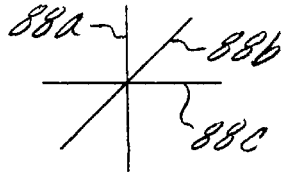

FIG. 12C illustrates rotation in polarization of a signal as it propagates between a common waveguide having ports that are at an angle α polarization orientation with respect to each other and a fixed communication waveguide, where the waveguides are at a ninety (90) degree orientation with respect to each other as illustrated in FIG. 12A according to one embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The present invention provides various antenna feed assemblies for use in antennas having a fixed communication waveguide. The antenna feed assemblies of the present invention allow the polarization of the communication ports of the antenna to be reconfigured to meet application requirements for the antenna in a quick and easy manner. Importantly, the antenna feed assemblies allow for manufacture of one antenna design that can be used for many applications by simple adjustment in the field.

As an aid to understanding the various aspects of the present invention, FIGS. 2, 3A, and 3B illustrates an antenna 92 that incorporates the antenna feed assembly 30 of the present invention. The antenna 92 includes a reflector 94 for directing signals transmitted to or from the antenna. Extending from the reflector in a forward direction is at least one boom arm 96. Connected to the end of the boom arm is a feedhorn 98 directed at the reflector for receiving and transmitting signals. Importantly, the antenna also includes an antenna feed assembly 30 according to the present invention having a common waveguide 32 connected to the feedhorn. The antenna also includes a fixed communication waveguide 48 for communication with the feedhorn fixedly connected to the boom arm 96 of the antenna and to the second end of the common waveguide 32. To rotate the common waveguide relative to the fixed communication waveguide, the antenna feed assembly includes a rotatable coupling 46 connected between the second port of the common waveguide and the fixed communication waveguide. The coupling allows the common waveguide to rotate with respect to the fixed waveguide to thereby alter the polarizations defined by the first and second ports while maintaining the predetermined difference in polarization between the first and second ports. FIG. 3A illustrates the common waveguide at a zero (0) rotation, and FIG. 3B illustrates the common waveguide rotated relative to the fixed communication waveguide by ninety (90) degrees.

With reference to FIGS. 2, 3A–3B, and 4A–4C an embodiment of the antenna feed assembly 30 according to the present invention is illustrated. The antenna feed assembly includes a common waveguide 32 having a body 34 extending longitudinally between first and second ends, 36 and 38, (FIG. 4A). The body of the waveguide also includes an opening 40 positioned at a point between the first and second ends. Associated with the opening 40 and the second end 38 of the common waveguide are two ports, 42 and 44, respectively.

The common waveguide is used as a conduit linking communication signals between the feedhorn of an antenna and receivers and transmitters connected to the antenna. The common waveguide 32 has a hollow interior that is sized and shaped at proper dimensions to support propagation of communication signals according to well known waveguide theory. The hollow interior illustrated in FIG. 4A is circular in shape, but it is understood that the interior could alternatively be rectangular. Rectangular waveguides are limited to either cross- or co-polarization configurations, while circular waveguides accept any polarization. As such, if the ports are configured at an angle other than 0 or 90 degrees with respect to each other, a circular waveguide is typically used.

The first and second ports, 42 and 44, associated with the common waveguide 32 are rectangular in shape, each having a length, 42*a* and 44*a*, and a width, 42*b* and 44*b*, respectively. The dimensions-of the ports are related to the particular frequencies of the communication signals that will be propagating in the waveguides. More particularly, the lengthwise dimension, 42*a* and 44*a*, of the ports supports propagation of the communication signal associated with the ports and is related to the cutoff wavelength of the signal. In this configuration, the lengthwise extension 42*a* of the first port 42 is a longitudinal dimension that extends in parallel with the longitudinal axis A of the common waveguide 32, and the lengthwise extension 44*a* of the second port 44 is a longitudinal dimension that extends perpendicular to the longitudinal extension A of the common waveguide.

Importantly, the first and second ports have a predetermined polarization angle a with respect to each other, (FIG. 4B). In this embodiment, the common waveguide is an OMT and the first and second ports have predetermined polarization angle with respect to each other of $\alpha$=90 degrees. In a cross-polarization configuration, the longitudinal dimension 42*a* of the first port 42 and the longitudinal axis A define a first plane extending vertically in FIG. 4A substantially bisecting the common waveguide. The longitudinal dimension 44*a* of the second port 44 and the longitudinal axis A define a second plane extending substantially horizontally in FIG. 4A and perpendicular to the first plane. This particular configuration is used in antennas for signals that are orthogonal with respect to each other.

With reference to FIGS. 4A–4C, the antenna feed assembly of the present invention further includes a rotatable coupling 46 connected to the flange 39 of the second end 38 of the common waveguide 32. The rotatable coupling is used to connect the common waveguide to a flange portion 47 of the fixed communication waveguide 48. The fixed communication waveguide has a port 50 having an end 50*a* that is connected to either a transmitter or receiver associated with the antenna.

Ideally, the rotatable coupling is configured to allow propagation of signals between the second port 44 of the common waveguide 32 and the port 50 of the fixed communication waveguide 48 regardless of the rotation orientation of the common waveguide 32 with respect to the fixed communication waveguide 48. When the second port 44 of the common waveguide 32 and the port 50 of the fixed communication waveguide are at the same polarization, the rotatable coupling should be a pass through conduit. But, as the common waveguide is rotated relative to the fixed communication waveguide 48, the rotatable coupling should manipulate signals communicated between the two waveguides such that the signals are at a proper polarization for each waveguide. There are many different types of the rotatable couplings and most of them include several moving parts and can be expensive. U.S. Pat. No. 4,528,528 to Augustin is one example of a rotatable coupling.

With reference to FIG. 6A, in general, most conventional rotatable couplings 52 include a plurality of sections 54 all connected to each other. Each section includes a through hole defining a section of a port 56 extending through the entire coupling. In a zero (0) degree rotation state, all of the sections are in line with each other, as well as all of the through holes defining the port 56. With reference to FIG. 6B, when one end of the coupling is rotated, the different sections, 54*a*–54*d*, rotate different incremental amounts, creating a stair step effect. As a signal propagates through the port, each section rotates the polarity of the signal. As such, when used in the antenna feed assembly of the present invention, when the common waveguide is rotated relative to the fixed communication waveguide, the signal is properly communicated between the two waveguides even though their ports are at different polarizations.

Although the rotatable coupling illustrated in FIGS. 6A and 6B provides an ideal coupling between the common waveguide and fixed communication waveguide, there are some drawbacks to these types of couplings. Specifically, these couplings include a large number of parts that may be susceptible to failure. Further, they are quite expensive for many cost sensitive, satellite antenna applications. For this reason, in some embodiments, the present invention uses a specialized rotary coupling that has a simpler, more cost effective design. This rotatable coupling represents a trade off between performance and cost.

Specifically, as will be described below, the rotatable coupling typically used in the antenna feed assembly of the present invention includes only one section as opposed to a plurality of sections. The section includes first and second portions that rotate with respect to each other and a rectangular port located in the first portion. At zero (0) degree rotation, the port is at a −45 degree angle and at a ninety (90) degree rotation, the port is oriented at a polarization of +45 degrees. At the zero degree position, the rotatable coupling is less advantageous because instead of the ports of the common waveguide, rotatable coupling, and fixed waveguide all lining up, the port of the coupling is at −45 degrees. However, because the ports of the waveguides are rectangular, they essentially match at the center of the ports, even though the ports may be rotated. Since signals typically propagate along the center of the waveguides, there is little signal degradation. As such, although the port of the rotatable coupling of the present invention does not match the orientation of the second port of the common waveguide and the port of the fixed communication waveguide at a zero (0) degree orientation, signals can be communicated at an acceptable loss between the common waveguide and the fixed communication waveguide at a reduced cost with less intricate equipment.

Importantly, however, the port of the rotatable coupling at ninety (90) degree rotation is at desired angle of +45 degrees to effectively orient signals communicated between the common and fixed communication waveguides. In this instance, the second port of the common waveguide and the port of the fixed communication waveguide are now rotated 90 degrees with respect to each other, and the port of the rotatable coupling rotates the polarization of signals passing between the common waveguide and fixed communication waveguide 45 degrees so that the signals are properly oriented for each waveguide.

One embodiment of the rotatable coupling 46 of the present invention is illustrated in FIGS. 7 and 8A–8D. In these figures the rotatable coupling is flipped front to back from the way it appears in FIGS. 4A, 5A, 9A, 10A, 11A and 12A, so that the parts of the rotatable coupling are more easily viewed. With reference to FIG. 7, the rotatable coupling 46 includes first and second flange portions, 60 and 62. The first portion is adaptable for connection to the second flange 39 of end 38 of the common waveguide 32, and the second portion is adaptable for connection to the flange 47 of the fixed communication waveguide 48. The first and second portions are rotatably connected to each other by a retainer ring 64, which fits within a groove 66 of the first portion 60. The outer circumference of the retainer ring is slightly larger than the opening 68 in the second portion 62 through which the first portion 60 is fitted. The retainer ring engages a retainer ridge 70 in the second portion 62 maintaining the first and second portions in rotatable connection with each other.

Importantly, the first portion 60 of the rotatable coupling 46 includes a rectangular port 72. The port allows for propagation of signals between the common waveguide 32 and the port 50 of the fixed waveguide 48, despite the relative orientations of their respective ports. FIGS. 8A and 8B illustrate perspective and cross-sectional perspective views of the rotatable coupling 46 at one orientation, while FIGS. 8C and 8D illustrate perspective and cross-sectional perspective views of the rotatable coupling after the first portion 60 has been rotated ninety (90) degrees with respect to the second portion 62 of the rotatable coupling.

The operation of the rotatable coupling 46 in conjunction with the common waveguide 32 of the present invention is illustrated in FIGS. 4A–4C and 5A–5C. Specifically, as illustrated in FIG. 4A, the first portion 60 of the rotatable coupling 46 is connected to the flange 39 of the common waveguide 32, and the second portion 62 is connected to the flange 47 of the fixed communication waveguide 48. FIGS. 4A–4B illustrate the antenna feed assembly at a zero (0) degree rotation, where the first port 42 of the common waveguide is positioned to accept signals propagating in a vertical polarization and the second port 44 is positioned to accept signals propagating in a horizontal polarization.

As can be seen, in this configuration, the second port 44 of the common waveguide 32 and the port 50 of the fixed communication waveguide 48 are at the same orientation. FIG. 4C illustrates the propagation of a horizontal signal 74 between the second port 44 of the common waveguide, the port 72 of the rotatable coupling, and the port 50 of the fixed communication waveguide 48. As can be seen, the signal 74 as it appears in the common waveguide is at a horizontal polarization 74*a*. When the signal enters the rotatable coupling, its polarization 74*b* is rotated by minus 45 degrees due to the minus 45 degree orientation of the port 72 of the rotatable coupling 46. Finally, the polarization 74*c* of the signal is rotated back to zero (0) degrees when propagating in the port 50 of the fixed waveguide 48.

Importantly, FIGS. 5A and 5B illustrate rotation R of the common waveguide 32 ninety (90) degrees relative to the fixed communication waveguide 48 to alter the polarization of the first 42 and second 44 ports of the common waveguide 32. To reconfigure the polarization of the ports of the common waveguide 32, the fasteners connecting the common waveguide to the rotatable coupling are loosened so that the common waveguide is rotatable. The common waveguide via the rotatable coupling is then rotated ninety (90) degrees. The fasteners are then retightened to place the waveguide and rotatable coupling in a fixed position. When rotated ninety (90) degrees, the first port is now positioned to accept signals propagating in a horizontal polarization, while the second port is positioned to accept signals propagating in vertical polarization.

In addition to allowing the common waveguide to rotate relative to the fixed communication waveguide, the rotatable coupling also ensures that signals properly propagate between the common waveguide 32 and the fixed communication waveguide 48, despite their rotational orientation. Specifically, as illustrated in FIGS. 5A and 5B, the second port 44 of the common waveguide is now rotated ninety (90) degrees with respect to the port 50 of the fixed communication waveguide 48. To ensure proper propagation of signals between the common waveguide 32 and the fixed communication waveguide 48, the first portion 60 of the rotatable coupling 46 containing the port 72 is also rotated with the common waveguide 32, thereby placing the port 72 at a 45 degree orientation.

FIG. 5C illustrates, in this instance, the propagation of a signal 76 between the second port 44 of the common waveguide, the port 72 of the rotatable coupling, and the port 50 of the fixed communication waveguide. As can be seen, the signal 76 as it appears in the common waveguide is at a vertical polarization 76*a*. When the signal enters the rotatable coupling, its polarization 76*b* is rotated by 45 degrees due to the 45 degree orientation of the port 72 of the rotatable coupling. Finally, the polarization 76*c* of the signal is rotated to zero (0) degrees when propagating in the port 50 of the fixed communication waveguide.

As can be seen from FIGS. 5A–5C, regardless of the orientation of the second port of the common waveguide 32 and the port of the fixed communication waveguide 48, signals are able to properly propagate between the two. It must be understood that the representations of the signals in FIGS. 4A and 5A remain true regardless of whether the fixed communication waveguide is connected to a receiver or a transmitter. In the instance, that the fixed communication waveguide is connected to a receiver the signals propagate in a direction RCV and in a direction XMT if connected to a transmitter.

As illustrated above, the first and second ports of the common waveguide can be configured by rotating the common waveguide relative to the fixed communication waveguide. With reference to FIGS. 4A and 5A, both the common waveguide and the rotatable coupling include flanges, 39, 60, and 62, respectively. These flanges include regularly spaced openings 91 through which fasteners 92 are passed through. The fasteners hold the common waveguide 32 and the second portion 62 of the rotary coupling 46 at a fixed position relative to each other. When the fasteners are loosened or removed, the common waveguide and first portion of the rotatable coupling are rotatable with respect to the second portion of the rotary coupling, thereby allowing the common waveguide to rotate independent of the fixed communication waveguide. It must be understood that the flanges may include a plurality of openings such that the waveguides may be rotated to several different angles R with respect to each other.

FIGS. 2A–2D illustrate configuration of the ports of the common waveguide in a cross-polarization configuration for cross-polarized signals, (i.e., $\alpha$=90). FIGS. 9A–10A and 11A–12A illustrate other configurations of the ports for different possible signal orientations. For example, FIGS. 9A and 10A illustrate a common waveguide having ports that are in a co-planar configuration for co-planar signals, (i.e., $\alpha$=0). This common waveguide is a diplexer. FIGS. 11A and 12A illustrate a common waveguide having ports at angle $\alpha$ for signals having an angle at of polarization with respect to each other, other than 0 to 90 degrees.

With regard to FIGS. 9A–9C, the common waveguide 32 is a diplexer, and the first and second ports, 42 and 44, respectively, are co-polarized. Specifically, the longitudinal dimension 42*a* of the first port 42 and the longitudinal axis A define a first plane extending horizontally in FIG. 9A, and the longitudinal dimension 44*a* of the second port 44 and the longitudinal axis A define a second plane extending substantially horizontally in FIG. 9A such that the first and second planes are substantially coplanar. In this configuration, signals of the same polarization are accepted by both ports. With reference to FIG. 10A, when rotated ninety (90) degrees, the first and second ports of the common waveguide remain co-polarized, but they now have a different polarization with respect to signals propagating in the common waveguide. As can be seen from FIGS. 9B and 10B, the first portion 60 and port 72 of the rotary coupling 46 are rotated with the common waveguide 32, such that the orientation of the port transitions from −45 degrees to 45 degrees between the zero (0) and ninety (90) degree rotation of the common waveguide. Finally, FIGS. 9C and 10C illustrate the propagation of the signals between the common waveguide, rotatable coupling, and fixed communication waveguide depending on the rotation of the common waveguide, with FIG. 9C illustrating the signal 82*a*–82*c* for zero rotation and FIG. 10C illustrating the signal 84*a*–84*c* at ninety (90) degree rotation.

FIGS. 11A and 12A illustrate rotation of a common waveguide that has first and second ports oriented with respect to each other at an angle α other than 0 or 90 degrees. Specifically, the longitudinal dimension 44*a* of the second port 44 and the longitudinal axis A define a second plane extending substantially horizontally in FIG. 11A. The longitudinal dimension 42*a* of the first port 42 and the longitudinal axis A define a first plane extending at an angle other than horizontal or perpendicular as shown in FIG. 11B, such that the first and second planes are at an angle α other than 0 or 90 degrees. With reference to FIG. 12A, when rotated, the first and second ports of the common waveguide remain at the predetermined polarization angle α with respect to each other, but they now have a different polarization with respect to signals propagating in the common waveguide. As can be seen from FIGS. 11B and 12B, the first portion 60 and port 72 of the rotary coupling 46 are rotated with the common waveguide, such that the orientation of the port transitions from −45 degrees to 45 degrees between the zero (0) and ninety (90) degree rotation of the common waveguide. Finally, FIGS. 11C and 12C illustrate the propagation of the signals between the common waveguide, rotatable coupling, and fixed communication waveguide with FIG. 11C illustrating the signal 86*a*–86*c* for zero rotation and FIG. 12C illustrating the signal 88*a*–88*c* at ninety (90) degree rotation.

In the various embodiments illustrated above, the rotatable coupling 46 of the present invention allows the common waveguide 32 to rotate with respect to the fixed communication waveguide 48, but rotation with respect to the feedhorn is not specifically discussed. There are some embodiments, however, in which it is important that the feedhorn also remain fixed. Specifically, when an antenna includes a circular reflector and feedhorn, the feedhorn can be rotated along with the common waveguide without offsetting the symmetry between the feedhorn and antenna. However, when the reflector is irregularly shaped, such as elliptical, rotation of the feedhorn relative to the reflector will offset the symmetry between them. For this reason, in one embodiment, the common waveguide of the present invention further includes a flange 78 connected to the first end 36 of the common waveguide 32 for connecting the common waveguide to a flange 80 of the feedhorn 98 of the antenna, (FIGS. 3A and 3B). The flange 78 of the common waveguide has a pattern of openings 91 corresponding to openings in the flange of the feedhorn. The assembly further includes removable fasteners 92 that extend through the openings in the flanges to retain the common waveguide 32 and feedhorn in a fixed configuration.

When the common wave-guide is to be rotated, the fasteners are removed from the flange connecting the common waveguide and the feedhorn. Further, the fasteners in the flanges between the common waveguide and the rotatable coupling are loosened. The common waveguide, via the rotatable coupling, is rotated relative to the feedhorn and the common waveguide to reconfigure the polarization orientation of the ports of the common waveguide. The fasteners are then reconnected between the flanges of the common waveguide and the feedhorn, and the fasteners between the common waveguide and the rotatable coupling are retightened to fix the common waveguide at the new position.

As mentioned above, the antenna feed assembly includes first 42 and second 44 ports associated with the common waveguide 32. Depending on the embodiment, the second port 44 may be an integral part of either the common waveguide 32 or the rotatable coupling 46. For example, in one embodiment, the second port is an integral portion of the common waveguide and is adjacent to the second end 44 of the common waveguide. In an alternative embodiment, the second port is an integral part of the first portion 60 of the rotatable coupling 46, where it is rotatable with respect to the port 72 of the rotatable coupling 46.

In the above embodiments, the fixed communication waveguide 48 connected to the second end of the common waveguide is referred to as "fixed." It must be understood that this term is relative. In some embodiment, the transmitter or receiver connected to the fixed communication is, in turn, physically connected to the boom arm or other structure of the antenna. However, in some embodiments, the term "fixed" may have a much broader meaning. For example, as discussed above, in some antenna configurations, the receiver electronics or transmitter is positioned behind the feed assembly in an in-line configuration. In this instance, it may be disadvantageous to move the receiver electronics or transmitter in light of damage that may be caused to them. In this instance, the receiver electronics or transmitter are essentially "fixed" as the term is used herein, and the present invention could be used to rotate the common waveguide relative to the in-line receiver electronics or transmitter.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An antenna feed assembly capable of configuring communication ports of an antenna having a fixed communication waveguide in a proper polarization, wherein said assembly comprises:

a common waveguide having a body extending longitudinally between first and second ends, with a first end that is capable of connection to a feedhorn of the antenna and a second end that is capable of connection to the fixed communication waveguide;

an opening formed in said body at a point between said first and second ends;

a first port in communication with said opening of said body and a second port in communication with said second end of said body, said first and second ports defining respective polarizations and having a predetermined difference in polarization between each other; and a rotatable coupling connected to said second end of said common waveguide and configurable for connection to the fixed communication waveguide, said coupling allowing said common waveguide to rotate with respect to the fixed communication waveguide to thereby alter the polarizations defined by said first and second ports while maintaining the predetermined difference in polarization between said first and second ports.

2. An assembly according to claim 1, wherein said second port is an integral portion of said second end of said common waveguide.

3. An assembly according to claim 1, wherein said second port is an integral portion of said rotatable coupling.

4. An assembly according to claim 1, wherein said rotatable coupling includes a first portion and second portion rotatably connected to one another, and wherein at least one of said portion includes a port oriented such that when said first and second portions are rotated with respect to each other the polarization of said port is altered.

5. An assembly according to claim 4, wherein one of said first and second portions includes a rectangular slot defining said port.

6. An assembly according to claim 1, wherein said first port is a rectangular slot extending longitudinally along an axis in a parallel direction with respect to the longitudinal extension of said body of said common waveguide, and wherein said second port is a rectangular slot extending longitudinally along an axis perpendicular to the lengthwise extension of said body.

7. An assembly according to claim 6, wherein said common waveguide is an orthogonal mode transducer, and wherein said first and second ports are in a cross-polarization orientation with respect to each other.

8. An assembly according to claim 6, wherein said cornmon waveguide is a diplexer, and wherein said first and second ports are in a co-polarization orientation with respect to each other.

9. An assembly according to claim 1, wherein said common waveguide further comprises a flange connected to said first end for connecting said common waveguide to a flange of the feedhorn of the antenna, wherein said flange of said common waveguide has a pattern of openings therethrough corresponding to openings in the flange of the feedhorn, wherein said assembly further comprises removable fasteners for extending through said openings in said flanges to retain said common waveguide and feedhorn in a fixed configuration, and wherein said common waveguide may be rotated independently of the feedhorr by removing said fasteners.

10. An assembly according to claim 1, wherein said second end of said common waveguide and said rotatable coupling further include flanges for mating said common waveguide and said rotatable coupling, wherein said flanges include a pattern of openings therethrough corresponding to each other, wherein said assembly further comprises removable fasteners extending through said openings in said flanges to retain said common waveguide and rotatable coupling in a fixed configuration, and wherein said common waveguide may be rotated independently of the fixed communication waveguide by removing said fasteners.

11. An assembly according to claim 1, wherein said coupling allows said common waveguide to rotate with respect to the fixed communication waveguide to any angle in the range of 0 to 90 degrees.

12. An antenna feed assembly for configuring communication ports of an antenna having a fixed communication waveguide in a proper polarization, wherein said assembly comprises:

an orthogonal mode transducer having a body extending between first and second ends with a first end that is capable of connection to a feedhorn of the antenna and a second end that is capable of connection to the fixed communication waveguide, said transducer further including an opening in said body at a point between said first and second ends;

a first port in communication with said opening of said body and a second port in communication with said second end of said body, said first and second ports defining respective polarizations that are orthogonal with respect to each other; and a rotatable coupling connected to said second end of said transducer and configured for connection to the fixed communication waveguide, wherein said rotatable coupling allows said transducer to rotate with respect to the fixed communication waveguide to thereby alter the polarizations defined by said first and second ports while maintaining said first and second port in an orthogonal polarization relationship.

13. An assembly according to claim 12, wherein said rotatable coupling includes a first portion and second portion rotatably connected to one another, and wherein at least one of said portions includes a port oriented such that when said first and second portions are rotated with respect to each other the polarization of said port is altered.

14. An assembly according to claim 13, wherein one of said first and second portions includes a rectangular slot defining said port.

15. An assembly according to claim 12, wherein said transducer further comprises a flange connected to said first end for connecting said transducer to a flange of the feedhorn of the antenna, wherein said flange of said transducer has a pattern of openings therethrough corresponding to openings in the flange of the feedhorn, wherein said assembly further comprises removable fasteners for extending through said openings in said flanges to retain said transducer and feedhorn in a fixed configuration, and wherein said transducer may be rotated independently of the feedhorn by removing said fasteners.

16. An antenna feed assembly for configuring communication ports of an antenna having a fixed communication waveguide in a proper polarization, wherein said assembly comprises:

a diplexer having a body extending between first and second ends with a first end that is capable of connection to a feedhorn of the antenna and a second end that is capable of connection to the fixed communication waveguide, said diplexer further including an opening in said body at a point between said first and second ends;

a first port in communication with said opening of said body of said diplexer and a second port in communication with said second end of said diplexer, said first and second ports having the same polarization with respect to each other; and a rotatable coupling connected to said second end of said diplexer and for connection to the fixed communication waveguide, wherein said rotatable coupling allows said diplexer to rotate with respect to the fixed communication waveguide to thereby alter the polarizations defined by said first and second ports while maintaining said first and second ports at the same polarization with respect to each other.

17. An assembly according to claim 16, wherein said rotatable coupling includes a first portion and second portion rotatably connected to one another, and wherein at least one of said portions includes a port oriented such that when said first and second portions are rotated with respect to each other the polarization of said port is altered.

18. An assembly according to claim 17, wherein one of said first and second portions includes a rectangular slot defining said port.

19. An assembly according to claim 16, wherein said diplexer further comprises a flange connected to said first end for connecting said diplexer to a flange of the feedhorn of the antenna, wherein said flange of said common waveguide has a pattern of openings therethrough corresponding to openings in the flange of the feedhorn, wherein said assembly further comprises removable fasteners for extending through said openings in said flanges to retain said diplexer and feedhorn in a fixed configuration, and wherein said diplexer may be rotated independently of the feedhorn by removing said fasteners.

20. An antenna having communication ports with selectable polarizations comprising:

a reflector for directing signals transmitted to or from the antenna;

at least one boom arm extending in a forwardly direction from said reflector;

a feedhorn mounted on said boom arm forwardly of said reflector and directed at the reflector for at least one of receiving and transmitting signals;

a common waveguide having a body extending longitudinally between first and second ends and an opening in said body at a point between said first and second ends, wherein said first end is operably connected to said feedhorn;

a first port in communication with said opening of said body of said waveguide and a second port in communication with said second end of said body, wherein said first and second ports define respective polarizations and have a predetermined difference in polarization between each other;

a fixed waveguide for communication with said feedhorn fixedly connected to said boom arm of said antenna and having a port with a fixed polarization operably connected to said second end of said common waveguide; and a rotatable coupling operably connected between said second port of said common waveguide and said fixed waveguide, wherein said coupling allows said common waveguide to rotate with respect to said fixed waveguide to thereby alter the polarizations defined by said first and second ports while maintaining the predetermined difference in polarization between said first and second ports.

21. An antenna according to claim 20, wherein said rotatable coupling includes a first portion and second portion rotatably connected to one another, and wherein at least one of said portions includes a port oriented such that when said first and second portions are rotated with respect to each other the polarization of said port is altered.

22. An antenna according to claim 21, wherein one of said first and second portions includes a rectangular slot defining said port.

23. An antenna according to claim 20, wherein said common waveguide further comprises a flange connected to said first end for connecting said common waveguide to a flange of the feedhorn of the antenna, wherein said flange of said common waveguide has a pattern of openings therethrough corresponding to openings in the flange of the feedhorn, wherein said assembly further comprises removable fasteners for extending through said openings in said flanges to retain said common waveguide and feedhorn in a fixed configuration, and wherein said common waveguide may be rotated independently of the feedhorn by removing said fasteners.

24. An antenna according to claim 20, wherein said second end of said common waveguide and said rotatable coupling further include flanges for mating said common waveguide and said rotatable coupling, wherein said flanges include a pattern of openings therethrough corresponding to each other, wherein said assembly further comprises removable fasteners extending through said openings in said flanges to retain said common waveguide and rotatable coupling in a fixed configuration, and wherein said common waveguide may be rotated independently of the fixed communication waveguide by removing said fasteners.

* * * * *